US005884356A

United States Patent [19]

Zigerlig

[11] Patent Number: 5,884,356

[45] Date of Patent: Mar. 23, 1999

[54] ROTATING BRUSH WITH FLEXIBLE CLEANING ELEMENTS MADE OF EXPANDED CLOSED-CELL SYNTHETIC RESIN

[75] Inventor: Max Zigerlig, Tenero, Switzerland

[73] Assignee: Nowiteck Establishment, Vaduz, Liechtenstein

[21] Appl. No.: 749,647

[22] Filed: Nov. 15, 1996

[30] Foreign Application Priority Data

Jan. 31, 1996 [CH] Switzerland ..... 00240/96

[51] Int. Cl.[6] ..... B60S 3/06

[52] U.S. Cl. ..... 15/230.16; 15/230.19; 15/97.3; 15/DIG. 2

[58] Field of Search ..... 15/53.2, 53.3, 15/97.3, 230, 230.16, 230.19, DIG. 2

[56] References Cited

U.S. PATENT DOCUMENTS

| | | | |
|---|---|---|---|
| 3,577,839 | 5/1971 | Charvat et al. | 15/179 |
| 3,912,667 | 10/1975 | Spitzer et al. | 521/65 |
| 4,567,619 | 2/1986 | Clark | 15/97.3 |
| 5,077,859 | 1/1992 | Ennis | 15/230 |

FOREIGN PATENT DOCUMENTS

| | | | |
|---|---|---|---|
| 61-271157 | 12/1986 | Japan | 15/230.16 |

OTHER PUBLICATIONS

"How the Footwear Industry Uses ELVAX Resins", 6 pages, Du Pont Company, Aug. 1984 brochure.

"Celogen and Kempore, Chemical Blowing Agents, Methods of Expanding Rubber", pp. 1–43, Uniroyal Chemical Company, Inc., Oct. 1993 brochure.

Dupont Brochure—Table III. Similar to the formulation in claim 9 of the revised Favagrossa patent.

Celogen Brochure—Table 10. This is similar to the formulation in Claim 10 of the revised Favagrossa patent.

*Primary Examiner*—Mark Spisich

*Attorney, Agent, or Firm*—Young & Thompson

[57] ABSTRACT

In a rotating brush (1) which is particularly suitable for motorized systems for the automatic washing of vehicles, comprising a support member (2) that can be connected to a rotating device (3) and to a number of flexible cleaning elements (4) that support one another and are attached at one end (4*e*) to said support member (2), perpendicular thereto, said flexible cleaning elements (4) are made of an expanded closed-cell synthetic resin.

2 Claims, 2 Drawing Sheets

ROTATING BRUSH WITH FLEXIBLE CLEANING ELEMENTS MADE OF EXPANDED CLOSED-CELL SYNTHETIC RESIN

BACKGROUND OF THE INVENTION

This invention pertains to the technological sector that deals with the creation of systems for the automatic, motorized washing of vehicles, and more specifically to a new type of brush that can be used by connecting it to a rotating device that is part of the above-mentioned system itself.

DESCRIPTION OF THE RELATED ART

The rotating brushes that are currently in use are composed of a support member, which is usually cylindrical (and, as mentioned, is attached by known methods to a rotating device), to the outer surface of which are attached a number of flexible cleaning elements that support one another and are attached at their ends to the support member itself, perpendicular thereto.

As we know, the cleaning and automatic washing of, e.g., the body of a motor vehicle are accomplished by having several brushes of the type mentioned above rotate in such a way that the flexible elements, which are held in a predetermined configuration by the action of the centrifugal force that is generated by the rotation of the brushes, are pushed against the body of the vehicle once water and/or suitable washing solutions or emulsions have been applied.

Up until now, the above-mentioned cleaning elements have in most cases been made of polyethylene (in the form of wires) or felt (in the form of strips or fringes).

In the former case, the free end of each wire that comprises the brush is flattened by a special procedure that is called "feathering", thereby lengthening it in order to distribute its impact over a larger surface area while at the same time enlarging the cleaning surface. Over time, tiny rock-like or metal-like particles that come from previously cleaned surfaces deposit on the above-mentioned end which, after the above-described washing, is wrinkled and porous to a certain extent, and said particles, which become embedded in the above-mentioned rough and porous parts, remain there in the form of an incrustation, thus forming abrasive zones that can scratch the paint jobs of the bodies of the vehicles being washed, causing slight pitting in them.

This kind of problem becomes even more acute in the case of elements that are made of felt, whose somewhat spongy consistency is even more likely to incorporate the above-mentioned particles.

In view of the strong tendency of felt to absorb liquids with which it comes into contact, there is the additional drawback that, at temperatures even approaching zero degrees and owing to contribution to cooling that is caused by the evaporation that is created by the swirling motion of the brushes, the elements tend to freeze completely or partially, thus becoming stiff and impeding the operation of the system.

SUMMARY OF THE INVENTION

The inventor of this invention has solved the above-described problems, while also providing other advantages that are explained in greater detail below, by making the above-mentioned flexible cleaning elements out of an expanded closed-cell synthetic resin that also has the characteristics of softness and flexibility required in this case, does not have any significant roughness or porosity, and thus cannot absorb any liquids that can freeze or incorporate any solid abrasive particles, thereby ensuring completely thorough washing without the risk of the cleaning elements freezing or causing pitting.

The object of this invention consists of a rotating brush for washing surfaces that is particularly suitable for motorized systems for the automatic washing of vehicles and includes a support member that can be attached to a rotating device and a number of flexible cleaning elements that support one another and are attached at their ends to the support member itself, perpendicular thereto, characterized in that said flexible elements are made of an expanded closed-cell synthetic resin.

The invention will now be described in greater detail using some embodiments that are neither limiting or binding with respect to other possible embodiments and, considering which, other advantages that can be achieved with said embodiments will become evident.

BRIEF DESCRIPTION OF THE DRAWINGS

In making the above-mentioned description, reference will be made to the attached drawings, where.

DESCRIPTION OF THE PREFERRED EMBODIMENTS

Figure 1:
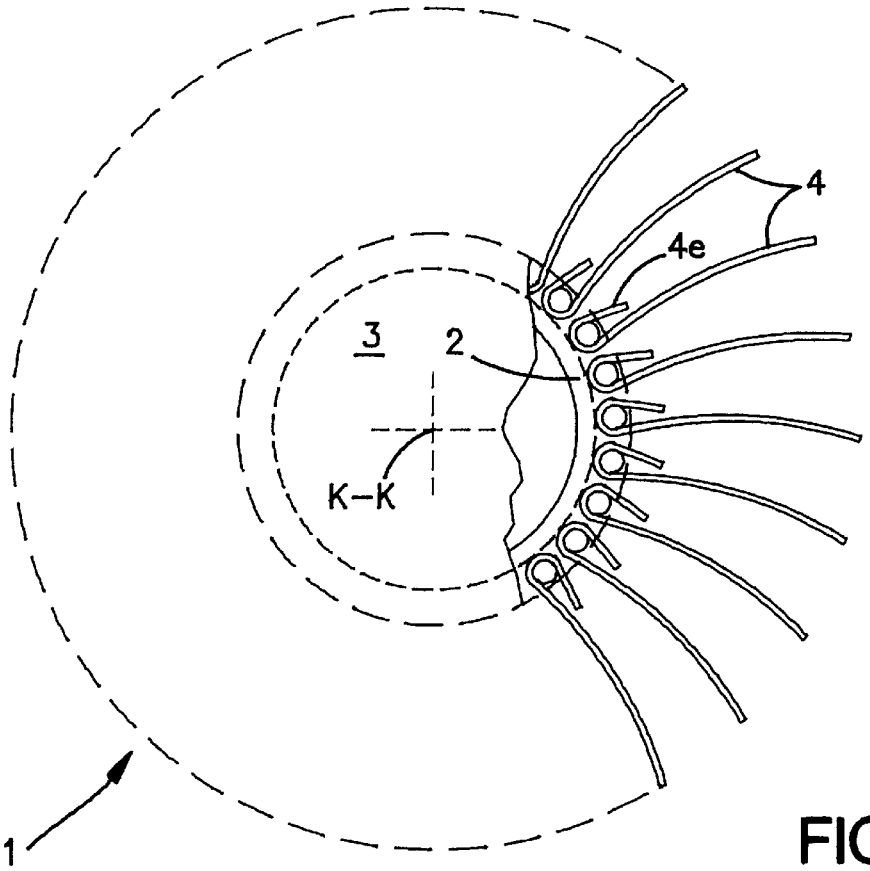
FIG. 1 shows a side view of a brush according to the invention, in which at one end the flexible cleaning elements are attached to a cylindrical jacket.
Figure 2:
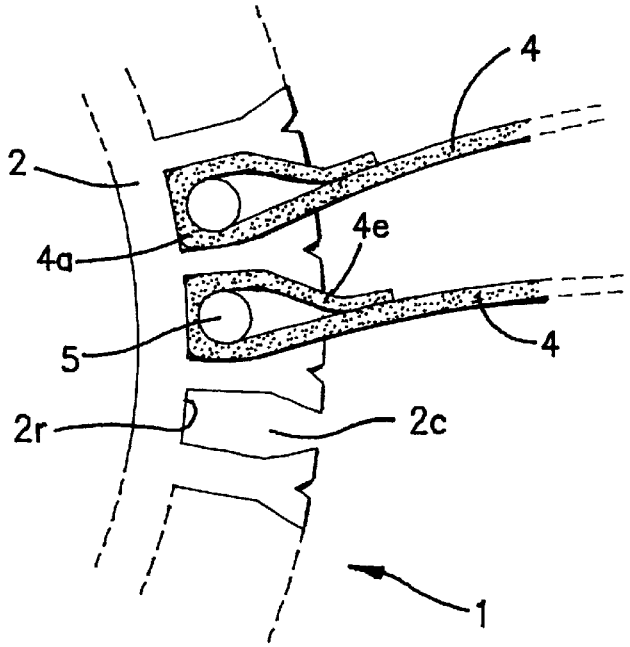
FIG. 2 shows an enlarged side view of a detail of the brush of FIG. 1, in which the attachment of the cleaning elements to said jacket is depicted.

Consider FIGS. 1 and 2: they show one possible means of attachment, which is known per se, between flexible cleaning elements 4 and a cylindrical jacket 2 on whose outside, over its entire length, there are a number of equally spaced radial incisions 2*r* that are arranged parallel to the axis of said jacket.

Each of said incisions 2*r* has a cross-section that is shaped in such a way as to form an open space 2*c* whose walls, at least in their end areas, converge toward the outside. To make the connection between each flexible cleaning element 4 and one of said incisions 2*r*, said element is folded back at one end 4*e* in such a way as to form a loop 4*a* that is inserted longitudinally into space 2*c* of an incision 2*r*. To secure it in that position, thus allowing the rest of cleaning element 4 to protrude through to the outside, it is sufficient to insert into said loop 4*a*, also in the longitudinal direction, a core 5 that is of such a size and shape as to compress, with a pre-established pressure, said loop 4*a* against the walls of space 2*c* that surround it and thus, by means of the friction that is generated thereby, prevent the loop from unthreading in the radial direction under the action of the centrifugal force and other forces that are generated during the operation of the brush. In the case of a brush according to the invention, the above-described attachment is sufficient to prevent the above-mentioned unthreading inasmuch as the compressibility and coefficient of friction of an expanded synthetic resin are such as to guarantee that the desired results will be achieved by simply designing the various components appropriately, without requiring holding stitches between the two opposing edges of loop 4*a* which, at the present state of the art, is sometimes necessary to secure in place flexible cleaning elements made of felt.

In addition to the functional advantages already described, other advantages are also obtained from the standpoint of the time and cost involved in producing a rotating brush.

After the synthetic resin is chemically treated to ensure expansion and polymerization so as to impart to it the physical and molecular closed-cell configuration, according to the inventor the resin to be used is preferably selected from among the group containing polyethylene, polyethylene with a vinyl acetate additive (E.V.A.), and polyurethane, but it is also possible to use other types of synthetic resin that prove to be suitable to the purpose.

There is also no problem with using other kinds of synthetic resin that have similar characteristics.

Embodiments of the invention that are produced with different materials but reflect the contents of the attached claims also fall within the framework of the protection offered by this patent application.

Figure 3:
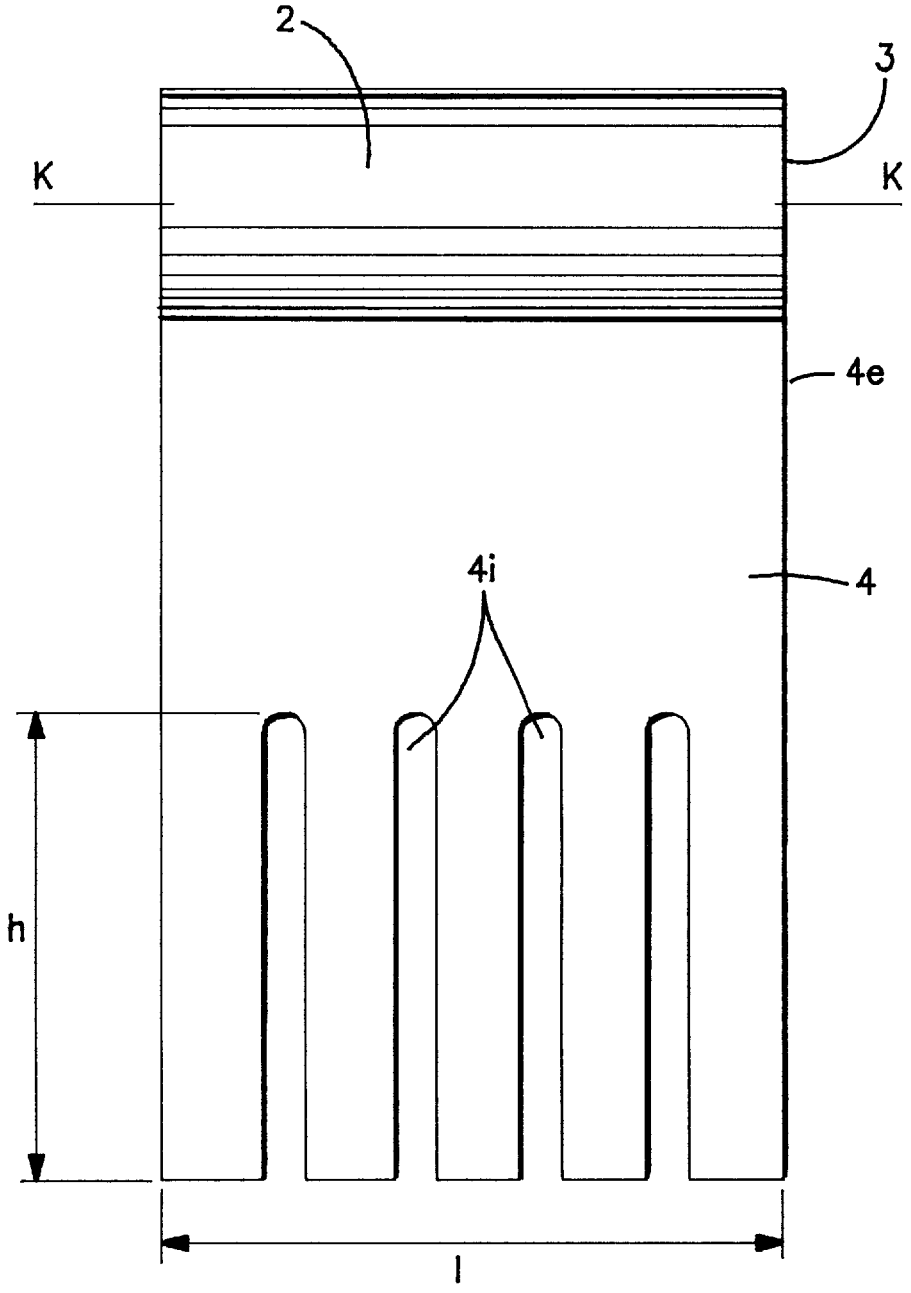
FIG. 3 shows a top view of an example of a flexible cleaning element laid flat that is attached to a cylindrical jacket in a brush according to the invention.

Said flexible cleaning elements 4 may be shaped and formed as is most appropriate, as dictated by the know-how of one skilled in the art: for example, an element may be designed to lay flat, as shown in FIG. 3; aside from the attachment to jacket 2, which may be done as shown or by other methods that are known, a preferred embodiment of the element itself, which is also known per se, specifies that on an element, which has a width I that is essentially equal to that of jacket 2, be made a series of parallel incisions **4*i* that are of a predetermined length h and be perpendicular to axis of rotation K—K of brush 1**, in such a way as to form a fringe. obviously, however, one skilled in the art would be aware of numerous other embodiments, depending on the particular technical requirements of the various cases.

I claim:

1. A rotating washing brush, comprising:

a rotating brush support providing an endless brush support surface;

a jacket secured on an interior surface to said rotating brush support and comprising on an exterior surface consecutive wash element retention bands;

plural wash elements, each of said plural wash elements being secured to one of said consecutive wash element retention bands, said each of said plural wash elements comprising a strip of closed-cell, synthetic resin material with a fringed end comprised of plural intermixed, parallel finger and open sections so as to form an open, fringed application end, said synthetic resin material being selected from the group consisting of polyurethane and polyethylene with a vinyl acetate additive, and each of said wash element retention bands being sized to accept a mounting end of one of said plural wash elements and cooperatively with a retaining core, to compress closed cells of said mounting end sufficiently so that said one of said plural wash elements will remain secured to said each of said wash element retention bands during operation of said rotating washing brush.

2. A rotating brush for washing surfaces, which is particularly suitable for systems for the automatic washing of vehicles, comprising a support member that can be connected to a rotating device and to a number of flexible cleaning elements that support one another and are attached at their ends to said support member, perpendicular thereto, said flexible cleaning elements being made of an expanded closed-cell synthetic resin, said synthetic resin being selected from the group consisting of polyethylene with a vinyl acetate additive and polyurethane, said flexible cleaning elements having a flat layout and a width that is essentially equal to that of said support member to which they are attached and have a series of parallel incisions that are of a predetermined length and a predetermined width so as to form parallel open areas and are perpendicular to an axis of rotation of said rotating brush, in such a way as to form an open fringe, and said support member being composed of a cylindrical jacket which, on its outside, over its entire length, has a number of equally spaced radial incisions that are arranged parallel to the axis of said jacket, wherein each incision has a cross-section that is shaped in such a way as to form an open space with walls that converge toward the outside and each of said flexible cleaning elements is folded back at one end in such a way that a loop that is thus formed can be held in one of said spaces and can remain therein because into it is inserted, in the longitudinal direction, a core that is shaped in such a way as to compress with a predetermined pressure said loop against the walls of said space, thus keeping said flexible cleaning element from unthreading.

* * * * *